United States Patent [19]

Hinton et al.

[11] 4,285,180

[45] Aug. 25, 1981

[54] WATERSTOPS

[75] Inventors: Kevin Hinton, Hitchin, England; Martin S. Barnes, Pittsford, N.Y.

[73] Assignee: Schlegel (UK) Ltd., England

[21] Appl. No.: 24,494

[22] Filed: Mar. 27, 1979

[51] Int. Cl.[3] ..... E01C 11/04

[52] U.S. Cl. ..... 52/396; 404/66

[58] Field of Search ..... 404/66, 64, 67, 70; 52/396; 277/207, 230

[56] References Cited

U.S. PATENT DOCUMENTS

| | | | |
|---|---|---|---|
| 3,884,000 | 5/1975 | Faleij | 52/396 |
| 3,982,365 | 9/1976 | Noel | 404/64 |
| 4,111,583 | 9/1978 | Brady | 52/396 |

FOREIGN PATENT DOCUMENTS

| | | | |
|---|---|---|---|
| 1016106 | 1/1966 | United Kingdom | 52/396 |
| 1051882 | 12/1966 | United Kingdom | 404/67 |

*Primary Examiner*—Robert I. Smith

*Attorney, Agent, or Firm*—Steele, Gould & Fried

[57] ABSTRACT

The invention relates to a waterstop for providing a water-tight seal between layers of concrete. Flexible waterstops are known and are usually attached to a convenient structure such as steel reinforcing bars by individual loops of wire which pass through eyelets in the edge of the waterstop. The present invention provides a waterstop which has integral transverse loops of wire or similar strong material embedded in the waterstop material but projecting outwardly from it so that they can be used directly to attach waterstop to structure such as reinforcing rods or scaffolding. To provide strength, longitudinal stiffening members in the form of strands of cotton, wire or synthetic plastics material are knitted or woven into the inner portions of the loops embedded in the plastic or rubber waterstop material. These strands stiffen the waterstop and also help firmly to anchor the loops.

12 Claims, 4 Drawing Figures

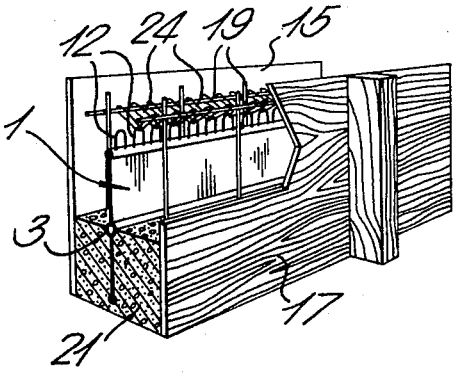
Fig. 3.
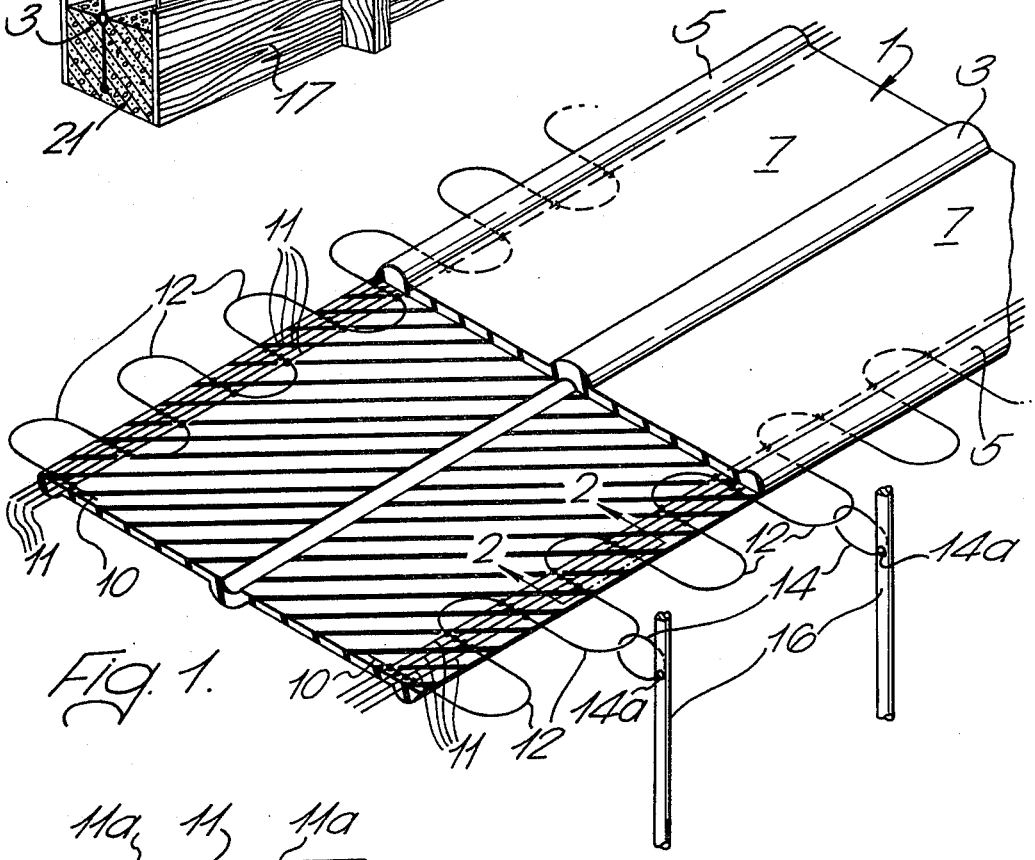
Fig. 1.
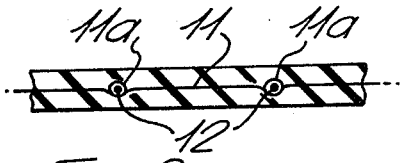
Fig. 2.
Fig. 4.
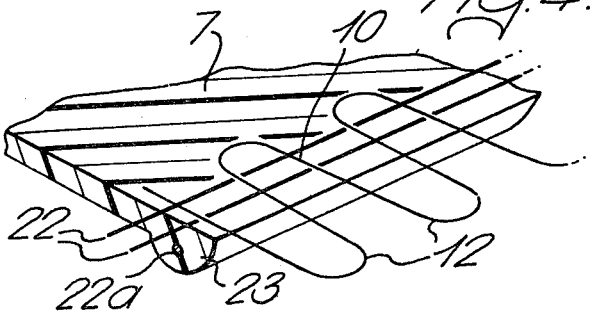

WATERSTOPS

Waterstops are most frequently used in the construction industry for providing a watertight seal between concrete slabs, i.e. between one pour of concrete and a subsequent pour. The present invention seeks to provide waterstops which can be connected to any convenient member, such as for example steel reinforcing bars prior to pouring the concrete without having to use special clips or lengths of wire threaded through eyelet holes specially formed in the edges of the waterstop. The disadvantages of these known methods of attachment are that the support members have to be attached to the waterstop on site, which is time consuming and often difficult to achieve. Furthermore, it means that waterstops, support members and possibly also clips all have to be ordered as separate items with a possibility of running out of one of the items during the construction phase. The present invention seeks to overcome this disadvantage.

The present invention provides a waterstop having integral supporting members which have inner portions embedded in the material of the waterstop and portions extending laterally therefrom in the form of loops and a plurality of longitudinal stiffening members extending lengthwise of the waterstop and bonded to the inner portions of the loops.

Preferably, the supporting members are inserted into the waterstop either during formation of the waterstop profile or immediately after the waterstop profile is formed, and in the preferred arrangement they are fed into an extruded waterstop profile immediately downstream of an extruder while the waterstop profile is still in a soft or semi-molten state, and held in place by suitable guides while the rubber or plastics of the profile is cured and set.

The supporting members on each side edge of the waterstop may comprise spaced loops formed from a zig zag shaped length of suitably strong material which is partially embedded in the side edge of the waterstop, and which is woven or interstitched with one or more warps of fine steel wire, synthetic plastics, fibre glass, cotton or other material capable of resisting the temperature experienced in a rubber or plastics extruder. The loops project outwardly from the side edges and may be anchored to suitable site materials in order to provide accurate location of the waterstop.

Although the transverse supporting members are preferably made of wire, they may be made of plastics or other materials and likewise, the flexible spacing elements may be made of metallic wires or of plastic material, fabric or other materials.

BRIEF DESCRIPTION OF THE PREFERRED EMBODIMENT

In the drawings:

FIG. 1 is a perspective view of a length of one construction of waterstop profile, having transverse looped support members, partly in section;

FIG. 2 is a section on the line 2—2 shown in FIG. 1;

FIG. 3 is a perspective view of the waterstop of FIG. 1 located in the first pour of a vertical concrete wall; and FIG. 4 is an enlarged scrap section of one corner of a modified form of the waterstop shown in FIG. 1.

DETAILED DESCRIPTION OF THE PREFERRED EMBODIMENTS

The waterstop profile shown in FIG. 1 is extruded from rubber or plastics material 1 and is of the generally known "centre bulb type" in that it includes a central hollow cylindrical portion 3 connected to substantially round outer bulbous portions 5 by flat web portions 7. The outer portions 5 may, if desired, carry outwardly extending flanges (not shown) of the same thickness as the flat web portion 7. The waterstop profile shown in FIG. 1 can be of any required length and throughout its length is provided at each longitudinal edge with transversely extending wire support members 10 in zig-zag or sinusoidal form with portions 12 extending laterally outwards in the form of loops beyond both the circular edge portions 5. Flexible stiffening elements 11 or warps extend longitudinally of the waterstop profile and are interwoven with support members 10. There are preferably at least four of the elements 11 in this type of embodiment of the invention. They may be simply woven or they may be individually knotted at 11*a* to members 12 (see FIG. 2). The zig-zag support wires 12 may be moulded integrally into the waterstop in which case the stiffening members 11 are first woven, knitted or tied, or otherwise bonded to the support wires 12.

Thus the flexible elements 11 may be in the form of strands of metal, plastics (e.g. nylon strands), fabric or other material which are bonded to or woven or knitted into the inner ends of loops 12 of the transversely extending support members 10, thereby determining the spacing between the loops 12 (which may, for example, be about 1" apart). The flexible elements 11 also act as a stiffener for the waterstop profile, thus providing resistance to stretching under tensile loading. The flexible elements 11 also hold the support member 10 firmly in the waterstop so that when the waterstop is heavily loaded, e.g. during pouring of concrete, they will not pull out.

The waterstop 7 is shown in horizontal use in FIG. 1 to seal between two layers of concrete (not shown). The loops 12 are attached to vertical reinforcing bars 16 by ties 14 passing through apertures 14*a* in bars 16.

The stiffening members 11, shown in FIG. 1, may be replaced by a single steel wire or other metal rod or by two or three such wires or rods as shown in the modified form of waterstop illustrated in FIG. 4. The steel wires 22 are embedded in the extruded plastic waterstop 7 and are intercalated with the inner ends of loops, passing alternately above and below the individual portions of these loops as shown.

An additional stiffening wire 22*a* may be provided in the bulbous portion 23 at the edge of waterstop 7.

In the vertical concrete wall, part of which is shown in FIG. 3, shuttering 15, 17, is provided for the wall which is being reinforced by suitable horizontal and vertical reinforcement rod 19. A first pour of concrete 21 has been poured between the shuttering and a waterstop 1 is shown inserted in the upper part of the pour of concrete 21 so as to provide a watertight joint between the concrete 21 and the subsequent pour of concrete to be added. The support members 10 formed integrally with the waterstop are shown attached to the horizontal reinforcing rods 19, by tying the loops 12 to the rods using wire ties 24, thereby locating the waterstop in the upper portion of the pour of concrete 21 with the central portion 3 of the waterstop arranged substantially at the surface of the concrete 21. The loops 12 can be directly looped over reinforcing rods or can be tied to them by the individual ties 24 or continuous cables or ropes. In the case of joints in vertical walls, the lower support wires 12 may also be attached to the reinforcing rods 19 (beneath the concrete 21) so as to locate the lower end edge of the waterstop, or they may be cut off or even allowed to find their own position within the concrete.

Waterstops with integral support members according to the present invention may be supplied in rolls of indefinite length and are very simple to use in comparison with the more traditional waterstops which have to be supported by separate support members each of which has to be individually attached to the waterstop profile.

Although the invention has been described specifically with reference to waterstops, it will be appreciated that similar extrusions of rubber or plastics material may be provided with integral support members and it is to be understood that the expression "waterstop" is intended to embrace such similar extrusions. It is envisaged, for example, that the integral support member of the present invention could be incorporated in highway seals which are used to provide waterproof expansion gaps in concrete roadways.

We claim:

1. A waterstop, comprising:

a body of resilient material;

integral supporting members which have inner portions embedded in the body of said waterstop and outer portions extending laterally from both longitudinal side edges of the waterstop, said outer portions being in the form of spaced loops lying substantially in the plane of the waterstop; and, a plurality of longitudinal stiffening strands embedded in and extending lengthwise of the waterstop adjacent each of the side edges, said stiffening strands being in contact with said inner portions of said loops.

2. A waterstop as claimed in claim 1 wherein said spaced loops form part of a zig-zag shaped length of strong material.

3. A waterstop as claimed in claim 2, wherein the zig-zag shaped length of strong material is sinusoidal.

4. A waterstop as claimed in claim 2 wherein the longitudinal strands are flexible warps, bonded to the supporting members.

5. A waterstop as claimed in claim 4 wherein at least four wraps are provided, the warps being of material capable of resisting the temperatures experienced in a resilient material extruder.

6. A waterstop according to claim 4, wherein the supporting members and the longitudinal strands are knitted to one another.

7. A waterstop according to claim 4, wherein the supporting members and the longitudinal strands are woven to one another.

8. A waterstop according to claim 1 wherein the longitudinal members are made of steel.

9. A waterstop according to claim 1 wherein the stiffening members are made of steel.

10. A waterstop comprising:

an extruded sheet of elastomeric material, the sheet having a central hollow cylindrical portion and flat web portions on either side of the cylindrical portion in turn connected to the hollow cylindrical portion;

a series of loops of wire lying substantially in the plane of the waterstop, the loops extending from both longitudinal edges and having portions embedded in the flat web portions of the waterstop; and, stiffening strands extending longitudinally adjacent the side edges, interwoven with the portions of the supporting members embedded in the elastomeric material so as to anchor the wire loops and provide stiffening and strengthening of the waterstop.

11. A waterstop according to claim 10 and in which there are at least four stiffening strands and the stiffening strands are individually tied to each embedded portion of each of the loops of wire.

12. A waterstop according to claim 10 wherein the longitudinal edge regions of the elastomeric material have a generally round, bulbous cross section for keying with concrete.

* * * * *